US010473432B2

(12) United States Patent
Jen

(10) Patent No.: US 10,473,432 B2
(45) Date of Patent: Nov. 12, 2019

(54) DUAL INTERFACE RAIL MOUNT

(71) Applicant: Yi Huei Jen, Irvine, CA (US)

(72) Inventor: Yi Huei Jen, Irvine, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 14/529,045

(22) Filed: Oct. 30, 2014

(65) Prior Publication Data

US 2018/0216911 A1 Aug. 2, 2018

(51) Int. Cl.
*F41G 11/00* (2006.01)
*F41C 27/00* (2006.01)

(52) U.S. Cl.
CPC ..... *F41G 11/003* (2013.01); *F41C 27/00* (2013.01)

(58) Field of Classification Search
USPC ..... 42/90
See application file for complete search history.

(56) References Cited

U.S. PATENT DOCUMENTS 9,429,388 B2 * 8/2016 Mayberry ..... F41C 23/16
9,581,412 B2 * 2/2017 Cheng ..... F41G 11/005
9,625,233 B2 * 4/2017 Daniel ..... F41C 23/16
9,857,146 B1 * 1/2018 Shelton ..... F41G 11/003
9,891,020 B2 * 2/2018 Jen ..... F41C 23/16
9,964,380 B1 * 5/2018 Oglesby ..... F41C 23/16
2009/0100734 A1 * 4/2009 Swan ..... F41C 23/16 42/71.01
2011/0032694 A1 * 2/2011 Swan ..... F41C 23/16 362/157
2015/0219422 A1 * 8/2015 Kincel ..... F41G 11/003 29/525.11
2016/0091272 A1 * 3/2016 Hines ..... F41A 35/00 42/90
2017/0370675 A1 * 12/2017 Storch ..... F41C 23/16

* cited by examiner

*Primary Examiner* — Reginald S Tillman, Jr.
(74) *Attorney, Agent, or Firm* — Andy M. Han; Han IP PLLC

(57) ABSTRACT

A firearm accessory connecting device to be mounted on a rail interface system has two locking mechanism and alignment relief lugs by which the device can be aligned and secured onto either a KeyMod rail interface or an M-LOK rail interface. The two locking mechanisms situated at a first front-end and a second rear-end of the connecting device and defined by a screw hole whereby a screw will engage the top surface of the connecting device and extend through the screw hole to the interior surface of the rail interface wherein a nut will be used to secure the screw in position and hence the mount onto the rail. The alignment lugs located at specific distances along the bottom surface of the connecting device will be slidably attached and aligned onto the rail interface.

3 Claims, 2 Drawing Sheets

DUAL INTERFACE RAIL MOUNT

BACKGROUND

Firearm rail systems are typically integrated into the handguard of the firearm. This system provides a means of attachment of various mountable accessories such as scopes, sights, grips, and lights.

Universal mounts like the MIL-STD picatinny rail mounts provide a firm and secure mounting option for users, but at the expense of increased weight. This is detrimental to the user's abilities. The configuration of the picatinny rails requires many rails to span along the handguard. Therefore, a need existed for a system that would not add weight to the firearm but still provides a secure mounting point for accessories.

U.S. Pat. No. 8,752,320 B2 Accuracy International of North America, Inc. proposed a firearm with keyhole-shaped rail mounting points. This invention in its advanced stage of product development is now known as the KeyMod attachment system. This rail interface system was developed to provide multiple accessory compatibility without the need for the heavy aforementioned picatinny rail. This system is now widely used and provides many advantages over the previous mounting system. As with all inventions, drawbacks become apparent as time elapses and hence advancements must be made. The drawbacks of the invention include poor securement of polymer parts and the wide spacing needed for the KeyMod nut to clear the mount. The drawbacks are critical because many firearm manufacturers are making polymer parts to attach to the KeyMod interface due to the reduced costs of polymer versus metal, steel, and aluminum. Therefore, the most recent alternative rail interface system was designed as a free licensed platform. This rail interface is known as the M-LOK.

M-LOK is a modular locking accessory mounting system that allows direct attachment of a mountable accessory to a negative space mounting point. Unlike the keyhole shaped KeyMod rail interface, the M-LOK features large rounded square slots which is optimized for both metal and polymer mounting accessories. The advantages of the M-LOK are apparent, and as KeyMod did to the picatinny rail, the M-LOK is shaping up to be the next advancement in rail interface systems. The obvious issue with this advancement is that the M-LOK and the KeyMod are not cross compatible and hence accessories from one interface cannot be used on the other. Given that the major problem with KeyMod is the metal and polymer interaction issues, and not with stability or rigidity, the ability to utilize, for example a metal KeyMod mount on the M-LOK interface would be beneficial, at least financially.

Therefore, it is apparent that there exists a need in for a firearm accessory mount that can be attached onto dual rail interface systems namely the KeyMod and M-LOK attachment systems. It is a purpose of this invention to meet this requirement while providing the advantages of the prior art, and further purposes will become apparent to those skilled in the art.

FIELD OF INVENTION

The invention generally relates to a firearm rail mount for optics, scopes, and other mountable firearm accessories. More specifically, this invention relates to an apparatus for mounting weapon accessories onto different rail interface systems without forfeiting any of the advantages of the prior mounting apparatuses.

SUMMARY OF INVENTION

It is one objective of the present invention to provide a mounting device for a firearm accessory that will secure an accessory to the firearm. It is a further object of the invention to provide a mounting device for a firearm that can be utilized on different rail interface systems. It is yet another object of the invention to provide a mounting device for a firearm that will engage and be aligned onto the rail interface system via alignment relief lugs, configured to make contact with the firearm rail interface, and two screws and two nuts. The alignment relief lugs aim to alleviate the force of recoil or impact as well as provide alignment positioning for inserting the mount into a KeyMod or M-LOK slotted interface.

The objectives of the present invention, as mentioned above, are accomplished by providing a dual interface rail mount. The rail mount will be able to integrate with both the KeyMod and M-LOK attachment systems. This is accomplished by two different methods, with each method applicable to a specific interface.

The first method will utilize the relief lugs on a KeyMod "keyhole-shaped" slotted rail interface. This method will allow the alignment relief lugs to enter different KeyMod slots. At this point, the mount will be able to slide into position and be tightened by two screws and two nuts. The final position on the KeyMod interface will see the relief lugs having at least three contact points with the surface of the KeyMod slot.

The second method will also utilize the relief lugs, but on an M-LOK "rounded-square" slotted rail interface. This method will allow the alignment relief lugs to easily enter two different M-LOK slots and make contact with the front end and the walls of the slot provided by the negative space created by the M-LOK slots. In its final aligned position on an M-LOK system, the mount will be secured by two screws and two nuts.

DESCRIPTION OF DRAWINGS

The following descriptions are set forth and have been assigned numerical designations to enable the reader to understand the reasoning behind and the application of the present invention. Even though specific configurations are shown, it should be noted that these are merely for illustrative purposes. It will be apparent to those skilled in the art that there are different configurations a user might utilize when attaching the invention onto a rail interface.

The invention provides a connecting device to allow a user to utilize the same mount for different rail interface systems namely the M-LOK and KeyMod rail interface systems. Taken with reference to the claims, the figures provide an illustration of some of the different modes of operation wherein;

FIGS. 4 and 5 both show the front-end (4) and the rear-end (5) as well as the screw holes (2) and the alignment relief lugs (3). The difference is that FIG. 4 is the bottom view of the present invention (1) and shows the bottom surface (6). Meanwhile FIG. 5 is the top view of the present invention (1) and shows the top surface (7).

Figure 1:
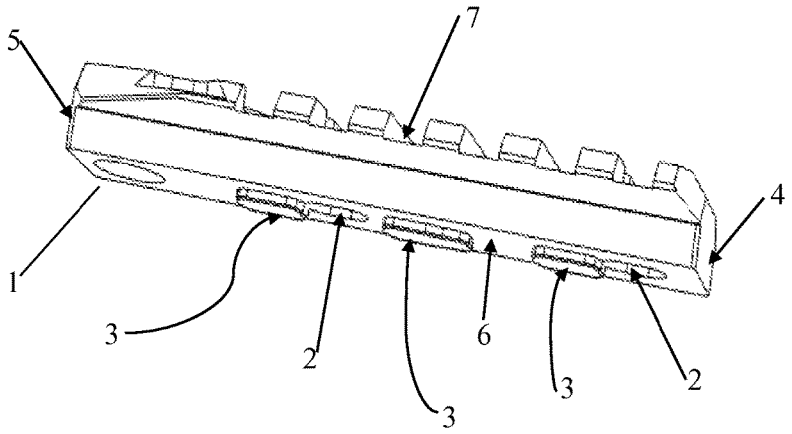
FIG. 1 is an illustration of the present invention (1) showing all its features. These include the top surface (7) and the bottom surface (6) through which a screw can be inserted from top to bottom via screw hole (2). Alignment relief lugs (3) will provide alignment of the device on a rail interface. Front-end (4) defines the first end and is the forward direction while rear-end (5) is the second end.
Figure 2:
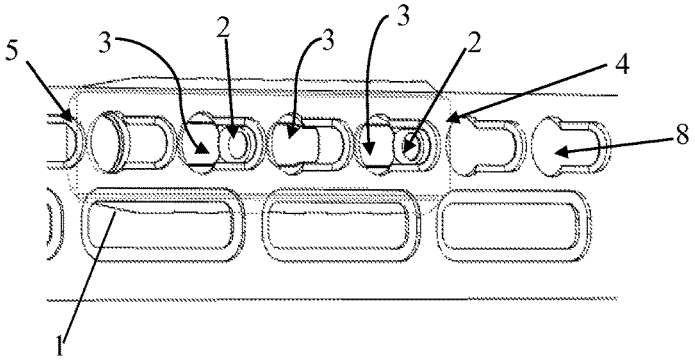
FIG. 2 is an illustration of the present invention (1), Dual Interface Rail Mount, attached to a KeyMod style rail interface system (8). Alignment relief lugs (3) are shown situated on the rail interface and is in contact with the walls created by the negative space left by the "key-hole" slots of the KeyMod interface (8). Additionally, screw holes (2) are also shown. It is apparent that the spacing of the screw holes (2) and the relief lugs (3) requires the use of at least three KeyMod interface (8) slots to be properly aligned, via relief lugs (3) and locked in position via a screw and nut mechanism to be inserted from a top surface (7) through the body of the present invention (1) and out of the bottom surface (6), then into the KeyMod interface (8) slot where a nut can be tightened and the device can be locked in position.
Figure 3:
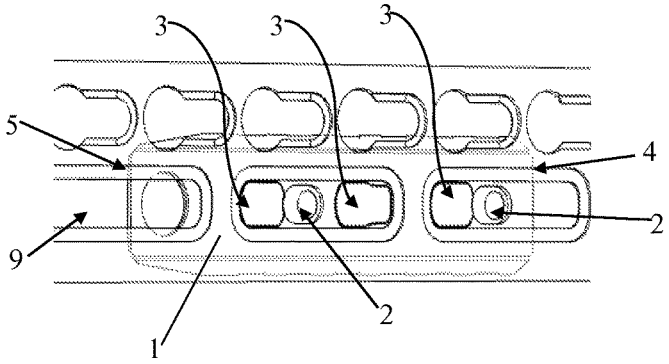
FIG. 3 is an illustration of the present invention (1), Dual Interface Rail Mount, attached to an M-LOK style rail interface (9). Similarly to FIG. 2, FIG. 3 also features the alignment relief lugs (3) situated between at least two different M-LOK interface (9) slots and provides lateral stability. Screw holes (2) further define a means of locking the present invention (1) onto the M-LOK rail interface (9) via a screw which can be inserted from a top surface (7) through to a bottom surface (6) and secured by a nut on the rail interface. Front-end (4) and rear-end (5) are also shown and are defined in a manner similar to that of FIG. 1 whereby front-end (4) is the forward direction.
Figure 4:
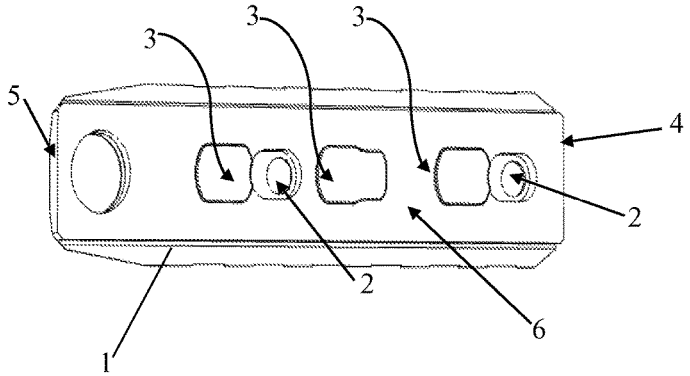
FIG. 4 and FIG. 5 further expands on the prior figure FIG. 1 to provide a clear depiction of the bottom view and the top view of the present invention (1).
Figure 5:
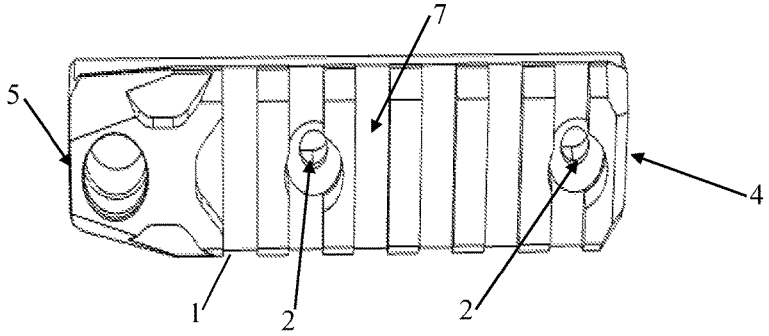

The invention claimed is:

1. A connecting device for a weapon accessory to be mounted onto different firearm rail interfaces, the connecting device comprising:

a mount having a first end portion, a second end portion, a top surface and a bottom surface, said first end portion being spaced from said second end portion, the bottom surface configured with a plurality of relief lugs protruding from the bottom surface to provide impact or recoil mitigation as well as proper mounting alignment, wherein:

the plurality of relief lugs situated on the bottom surface of the mount provide alignment for the mount onto firearm rail interfaces of a rounded-square style and a key-hole style, and;

the plurality of relief lugs are spaced at specific distances from each other to allow attachment and alignment to firearm rail interfaces of both the rounded-square style and the key-hole style such that:

when the mount is disposed on a first firearm rail interface of the rounded-square style, a first relief lug of the plurality of relief lugs is received in a first rounded-square slot of the first firearm rail interface and a second relief lug of the plurality of relief lugs is received in a second rounded-square slot of the first firearm rail interface, and when the mount is disposed on a second firearm rail interface of the key-hole style, the first relief lug is received in a first key-hole slot of the second firearm rail interface and the second relief lug is received in a second key-hole slot of the second firearm rail interface, the plurality of relief lugs feature both straight and rounded edges to match a contour of at least one wall of a negative space of slots on firearm rail interfaces of both the rounded-square style and the key-hole style.

2. The connecting device of claim 1, wherein the plurality of relief lugs further comprise a third relief lug such that:

when the mount is disposed on the first firearm rail interface of the rounded-square style, the third relief lug is received in the first rounded-square slot of the first firearm rail interface when the first relief lug is also received in the first rounded-square slot of the first firearm rail interface, and when the mount is disposed on the second firearm rail interface of the key-hole style, the third relief lug is received in a third key-hole slot of the second firearm rail interface.

3. The connecting device of claim 1, wherein the mount also has at least one screw hole traversing the mount from the top surface to the bottom surface, the at least one screw hole configured to allow a screw-and-nut mechanism to secure the mount onto the first firearm rail interface of the rounded-square style and the second firearm rail interface of the key-hole style.

* * * * *